US009943184B1

(12) United States Patent
Kao

(10) Patent No.: US 9,943,184 B1
(45) Date of Patent: Apr. 17, 2018

(54) WINDOW CURTAIN DRIVING ASSEMBLY

(71) Applicant: UNI-SOLEIL ENT. CO., LTD., Tainan (TW)

(72) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 0 days.

(21) Appl. No.: 15/359,853

(22) Filed: Nov. 23, 2016

(51) Int. Cl.

| | |
|---|---|
| ***E05D 15/00*** | (2006.01) |
| ***A47H 15/00*** | (2006.01) |
| ***A47H 15/02*** | (2006.01) |
| ***A47H 5/032*** | (2006.01) |

(52) U.S. Cl.
CPC ..... *A47H 15/02* (2013.01); *A47H 5/032* (2013.01)

(58) Field of Classification Search
CPC ..... E05D 15/00; E05D 15/1005; E05D 15/28; E05D 15/0608; E05D 15/0626; E05D 15/264; E05D 15/06; E05D 15/063; E05D 15/0643; E05D 15/0647; E05D 15/165; E05D 15/0621; E05D 15/0653; E05D 15/26; E05D 15/262; E05Y 2201/64; E05Y 2201/688; E05Y 2201/708; E05Y 2201/612; E05Y 2201/614; E05Y 2900/531; E05Y 2900/532; E05Y 2900/131; E05Y 2900/132; E05Y 2900/142; E06B 3/50; E06B 3/485; E06B 9/36; E06B 3/42; E06B 3/46; E06B 3/4609; E06B 3/4636; B60J 5/06; B60J 5/062; B60J 5/047; B60J 5/12; B60J 5/04; Y10T 16/364; Y10T 16/3813; Y10T 16/3837; Y10T 16/384; Y10T 16/3825; A47H 2023/025; A47H 1/04; A47H 15/00; A47H 15/02; A47H 15/032; A47H 15/04

See application file for complete search history.

(56) References Cited

U.S. PATENT DOCUMENTS 2,917,771 A * 12/1959 Labrie ..... E05D 15/063 16/105
2,957,197 A * 10/1960 Johnson, Jr. ..... E05D 15/063 16/105
3,049,083 A * 8/1962 Potter ..... B61B 10/022 104/94
3,193,871 A * 7/1965 Foltz ..... E05D 15/063 210/98
4,059,091 A * 11/1977 Cobb ..... F24B 1/192 126/545

(Continued)

FOREIGN PATENT DOCUMENTS

TW M521982 U 5/2016

*Primary Examiner* — Chuck Mah
(74) *Attorney, Agent, or Firm* — Rosenberg, Klein & Lee

(57) ABSTRACT

A window curtain driving assembly is revealed. A pulley driving assembly is pivotally connected to a main body. Pulleys disposed on the pulley driving assembly slid in a curtain track. Thereby the window curtain driving assembly rotates along curves of the window track so that it can also be applied to the curved window track. An auxiliary pulley set is mounted and fixed on a top of the main body. The pulley mount is oriented toward a given direction by the second latch bar on one side of the pulley driving assembly being mounted in the auxiliary pulley set. Thus the window curtain driving assembly can also be applied to a straight curtain track for extension or retraction of a curtain.

18 Claims, 10 Drawing Sheets

(56) References Cited

U.S. PATENT DOCUMENTS

| | | | | | |
|---|---|---|---|---|---|
| 4,945,605 | A * | 8/1990 | Haab | E05D 15/06 | 16/87 R |
| 5,090,171 | A * | 2/1992 | Kano | E04B 2/827 | 160/199 |
| 5,975,187 | A * | 11/1999 | Chou | A47H 5/02 | 160/345 |
| 6,141,827 | A * | 11/2000 | Wu | A47H 5/02 | 16/106 |
| 6,418,588 | B1 * | 7/2002 | Haab | E05D 15/063 | 16/87.2 |
| 7,117,559 | B1 * | 10/2006 | Barber | E05D 15/063 | 16/105 |
| 8,046,872 | B2 * | 11/2011 | Burgess, III | E05D 15/0639 | 16/103 |
| 8,418,318 | B2 * | 4/2013 | Scharf | A47H 5/032 | 16/106 |
| 8,819,993 | B1 * | 9/2014 | Chen | E05D 15/26 | 160/195 |
| 8,959,713 | B2 * | 2/2015 | Lagarde | A47H 15/02 | 16/102 |
| 9,320,379 | B2 * | 4/2016 | Sourain | A47H 1/04 | |
| 2004/0173117 | A1 * | 9/2004 | Galpin | B61C 13/04 | 105/148 |
| 2007/0136986 | A1 * | 6/2007 | Chen | A47H 15/04 | 16/91 |
| 2008/0289778 | A1 * | 11/2008 | Vrielink | A47H 5/0325 | 160/331 |
| 2010/0038041 | A1 * | 2/2010 | Liao | E05D 15/0613 | 160/196.1 |
| 2014/0284005 | A1 * | 9/2014 | Kao | A47H 13/14 | 160/84.06 |

* cited by examiner

WINDOW CURTAIN DRIVING ASSEMBLY

BACKGROUND OF THE INVENTION

Field of the Invention

The present invention relates to a window curtain driving assembly, especially to a window curtain driving assembly used in a curved curtain track.

Descriptions of Related Art

Curtains are used to maintain privacy, adjust the indoor lighting and decorate walls. Thus the curtain plays an important role in interior design.

Refer to Taiwanese Pat. No. M521982 U, a curtain guide arm adaptive to curved rails is revealed. The curtain guide arm mainly includes an arm and a moveable body. A pivot member such as a screw is set between the arm and the moveable body. Owing to the pivot member that pivotally connects the moveable body with the arm, the moveable body is adaptive to a curved rail and used for drawing a curtain fabric.

However, the moveable body and the arm are pivotally connected by the pivot member. The assembly or disassembly of the device is quite inconvenient for users. Moreover, tools are required for assembly or disassembly of the device. This is also troublesome.

In order to overcome the shortcomings mentioned above, there is room for improvement and a need to provide a novel window curtain driving assembly.

SUMMARY OF THE INVENTION

Therefore it is a primary object of the present invention to provide a window curtain driving assembly in which a pulley driving assembly is pivotally connected to a main body directly. No fastener such as a screw is required for assembling the window curtain driving assembly. Thus the assembly, disassembly or maintenance of the window curtain driving assembly is time and labor-saving. This is convenient for users.

In order to achieve the above object, a window curtain driving assembly of the present invention includes a main body, and at least one pulley driving assembly pivotally connected to the main body.

A locking part is disposed on a top of the main body. The locking part consists of a slot, an opening tapered inward and located at one side of the slot, and a curved hole connected to an inner end of the opening and communicating with the opening.

The pulley driving assembly consists of a pulley mount and two pulleys. The pulley is pivotally and coaxially disposed on each of two sides of the pulley mount. A locked part is integrated with the bottom end of the pulley mount and locked with the locking part of the main body. The locked part is composed of a block and a rod connected to a top end of the block. The outer diameter of the rod is smaller than that of the block. The block is mounted into the slot correspondingly while the rod is locked and fixed in the curved hole through the opening.

The window curtain driving assembly of the present invention has the following advantages:

1. No fastener such as a screw is required for assembling because that the pulley driving assembly is pivotally connected to the main body. Thus the assembly, disassembly or maintenance of the window curtain driving assembly is time and labor-saving. This is convenient for users.

2. The pulley driving assembly can rotate adaptively in a curved curtain track. Thus the window curtain driving assembly can be applied to the curved curtain track for extension or retraction of a curtain.

3. An auxiliary pulley set is mounted on the top of the main body. The pulley mount is oriented toward a given direction by a second latch bar on one side of the pulley driving assembly and a first latch bar of the main body being mounted into a mounting groove of the auxiliary pulley set. Thus the window curtain driving assembly of the present invention can also be applied to a straight curtain track for extension or retraction of a curtain.

4. While being applied to a straight curtain track, the window curtain driving assembly rotates in the curtain track more smoothly owing to the horizontally-rotating pulley sets of the auxiliary pulley set worked in combination with the vertically rotating pulleys of the pulley driving assembly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
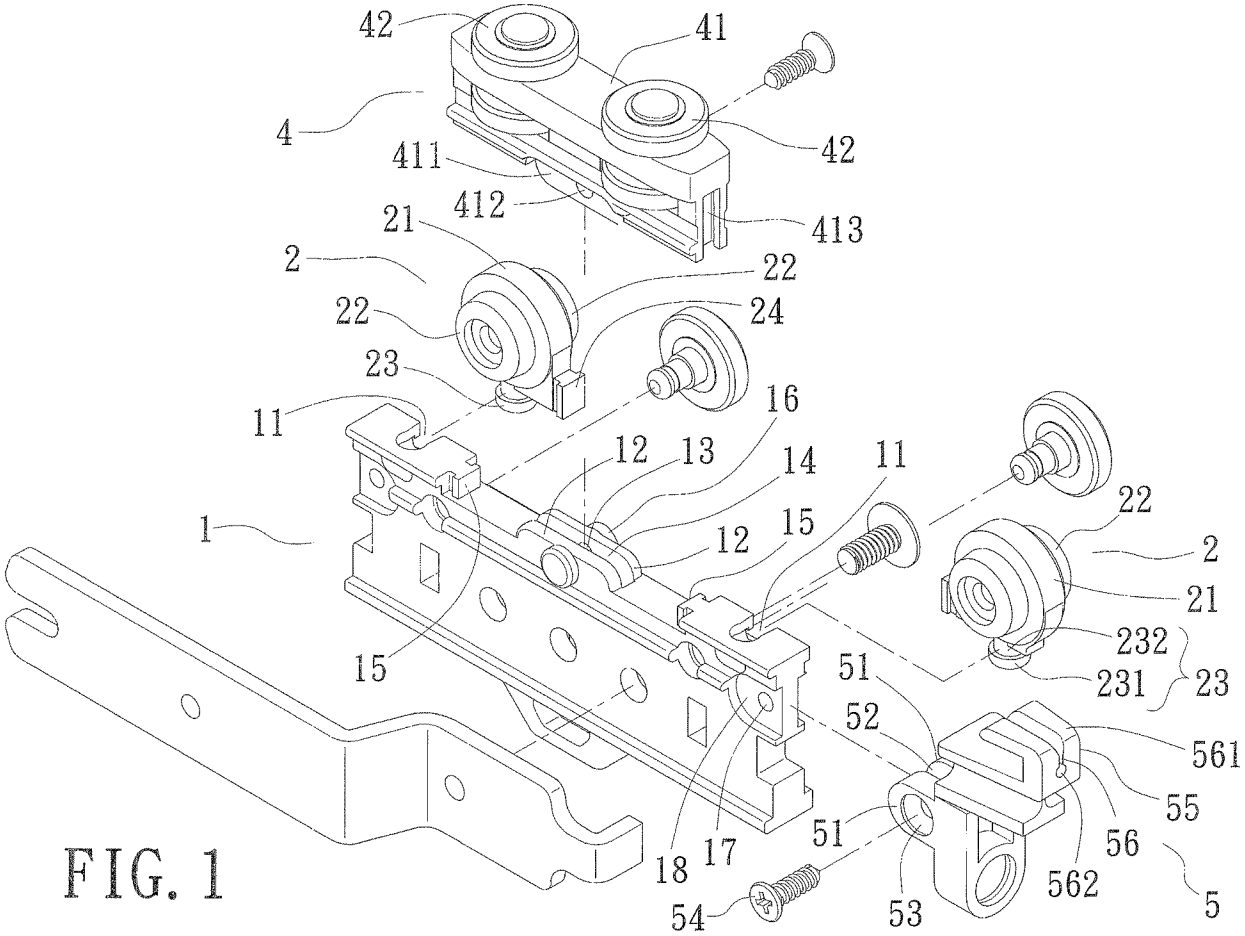
FIG. 1 is an explosive view of an embodiment of a window curtain driving assembly according to the present invention.
Figure 2:
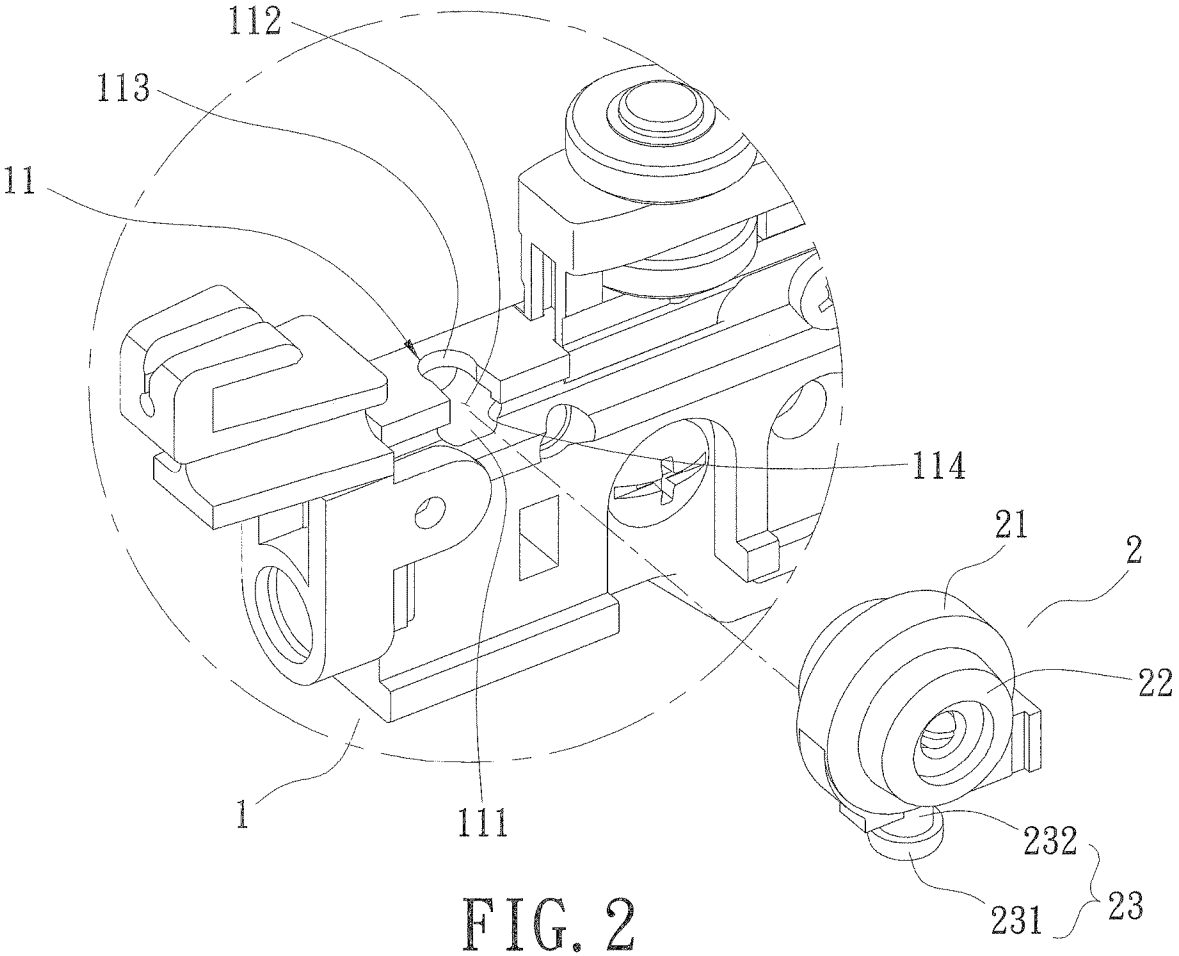
FIG. 2 is an explosive view of a main body and a pulley driving assembly of an embodiment according to the present invention.

Refer to FIG. 1 and FIG. 2, a window curtain driving assembly of the present invention includes a main body 1, and two pulley driving assemblies 2 pivotally connected to the main body 1.

A locking part 11 is disposed on a top of the main body 1. The locking part 11 consists of a slot 111, an opening tapered inward and a curved hole 113. The opening 112 and the curved hole 113 are arranged over and communicating with the slot 111. The curved hole 113 is connected to and communicating with an inner end of the opening 112.

The pulley driving assembly 2 is composed of a pulley mount 21 and two pulleys 22. The pulley 22 is pivotally and coaxially disposed on each of two sides of the pulley mount 21. A locked part 23 is integrated with the bottom end of the pulley mount 21 and locked with the locking part 11 of the main body 1. The locked part 23 includes a block 231 and a rod 232 connected to the top end of the block 231. The outer diameter of the rod 232 is smaller than that of the block 231. The block 231 is mounted into the slot 111 correspondingly and the rod 232 is locked and fixed in the curved hole 113 through the opening 112.

Figure 3:
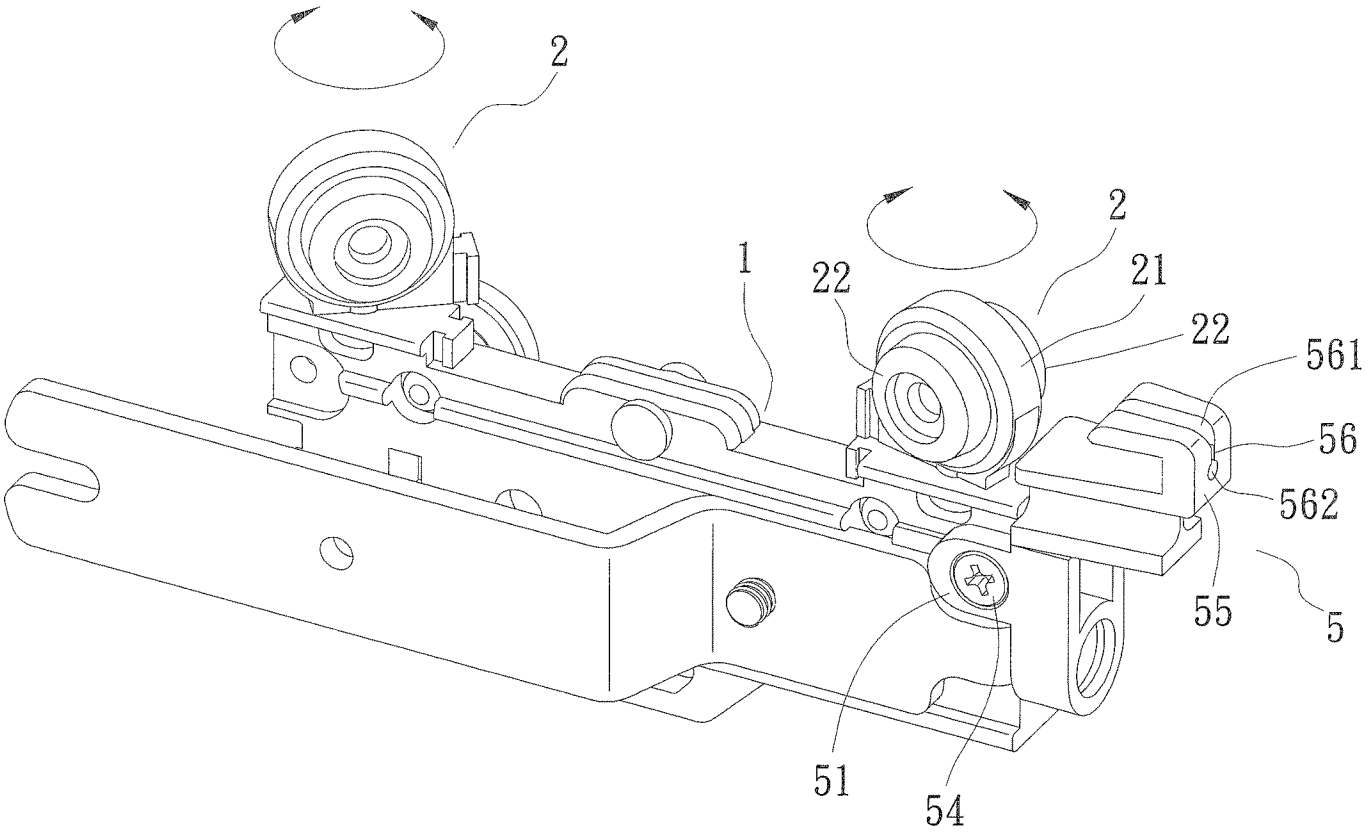
FIG. 3 is a perspective view of a main body assembled with a pulley driving assembly of an embodiment according to the present invention.
Figure 4:
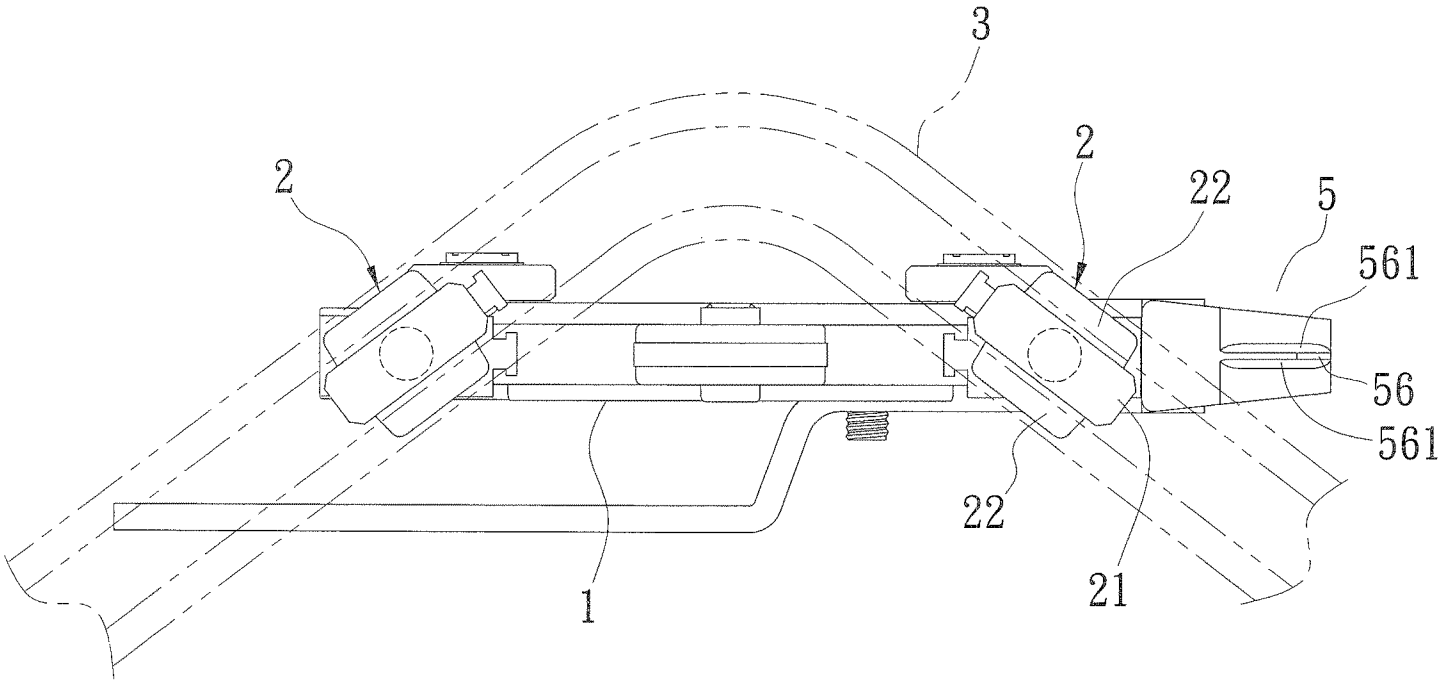
FIG. 4 is a schematic drawing showing an embodiment assembled on a curved curtain track according to the present invention.

Refer to FIG. 2, FIG. 3 and FIG. 4, the locked part 23 on the pulley mount 21 of the pulley driving assembly 2 is mounted into the locking part 11 of the main body 1. The rod 232 on the top end of the block 231 is mounted into and fixed in the curved hole 113 through the opening 112. Thus the pulley driving assembly 2 is pivotally connected to the main body 1 and rotated freely on the main body 1.

When the window curtain driving assembly of the present invention is installed at and sliding in a curved curtain track 3, the pulley driving assembly 2 can rotate adaptively in the curved curtain track 3 owing to pivot connection between the pulley driving assemblies 2 and the main body 1. Thus the window curtain driving assembly can extend or extract a curtain precisely while being applied to the curved curtain track 3, as shown in FIG. 4.

Refer to FIG. 2, a stopping block 114 is arranged at and projecting from each of two sides of the slot 111. Thus there is a height difference between the bottom side of the slot 111 and the stopping block 114. The higher difference prevents the locked part 23 from releasing from the locking part 11. Thus the pulley driving assembly 2 will not be released from the main body 1 easily while being applied with an external force.

Figure 5:
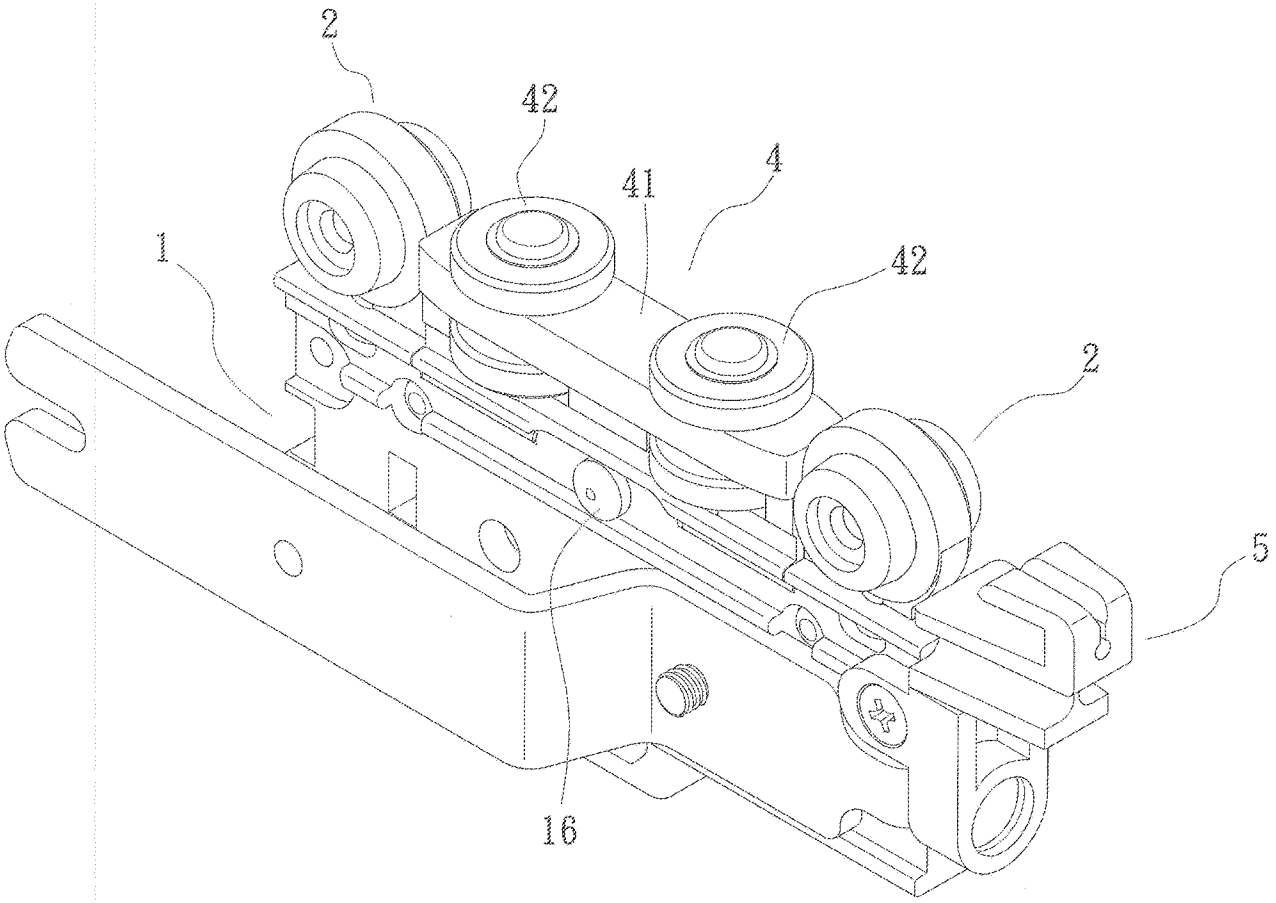
FIG. 5 is a perspective view of an embodiment of a window curtain driving assembly according to the present invention.
Figure 6:
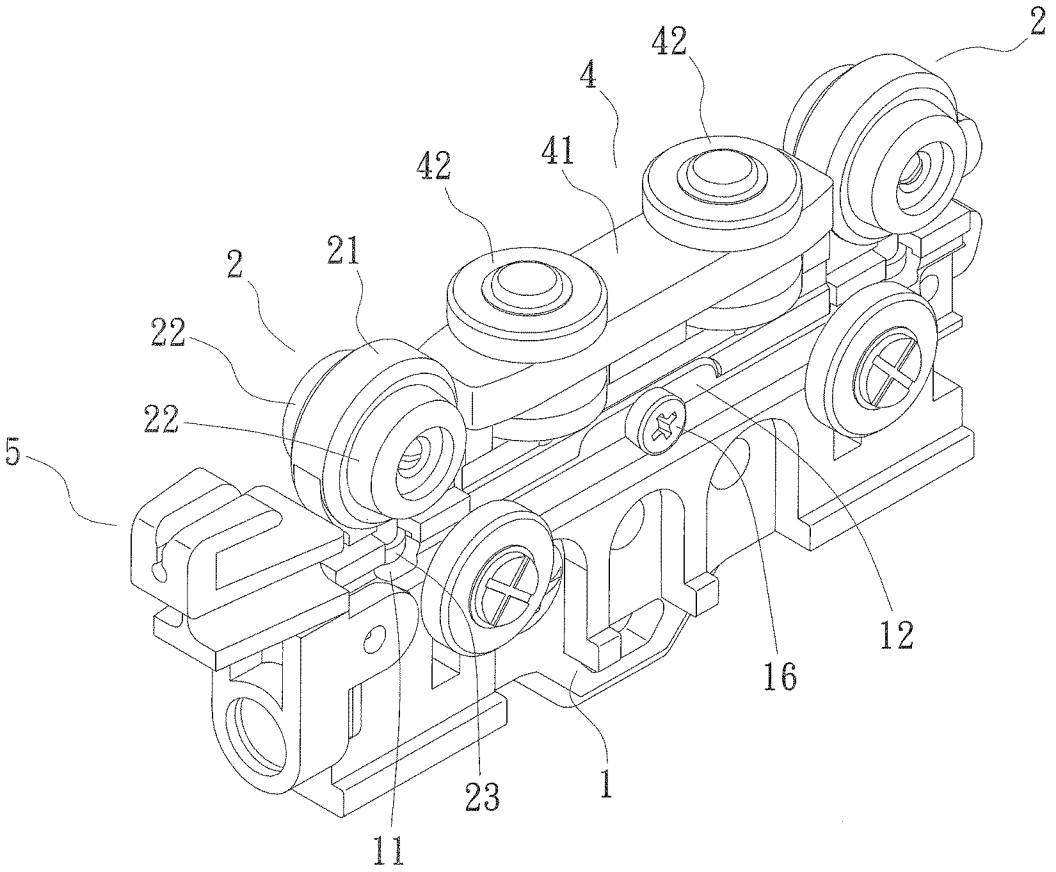
FIG. 6 is another perspective view of an embodiment of a window curtain driving assembly viewed from another angle according to the present invention.

Refer to FIG. 5 and FIG. 6, an auxiliary pulley set 4 is mounted and fixed between the lateral side of the pulley mount 21 and the top of the main body 1. The auxiliary pulley set 4 consists of an assembly base 41 and two pulley sets 42 pivotally connected to the assembly base 41. The rotating shaft of each pulley set 42 is in a vertical direction while the rotating shaft of each pulley 22 is in a horizontal direction.

Also refer to FIG. 1, two lugs 12 are projecting from the top end of the main body 1 and corresponding to each other. The lug 12 is arranged with a penetrating assembly hole 13 and a groove 14 is formed between the two lugs 12. A second latch bar 24 is projecting from one side of the pulley mount 21 close to the auxiliary pulley set 4 while a first latch bar 15 is disposed on top end of the main body 1. The first latch bar 15 is corresponding to and aligned with the second latch bar 24. An insertion piece 411 corresponding to the groove and having an insertion hole 412 is arranged at the assembly base 41. The insertion piece 411 is mounted into the groove 14 and the insertion hole 412 is aligned with the assembly hole 13. A positioning part 16 is passed through the insertion hole 412 and the assembly holes 13 so as to assembly the auxiliary pulley set 4 on the top end of the main body 1. Moreover, the auxiliary pulley set 4 is disposed with a mounting groove 413 having a side opening and corresponding to the second latch bar 24. The mounting groove 413 is used to hold the second latch bar 24 and the first latch bar 15. Thereby the auxiliary pulley set 4 is mounted and fixed between one side of the pulley mount 21 and the top end of the main body 1.

In this embodiment, the pulley mount 21 of the pulley driving assembly 2 is assembled with and fixed by the auxiliary pulley set 4 so that the pulley driving assembly 2 is unable to rotate on the main body 1. Thus the window curtain driving assembly of the present invention can be used in a straight curtain track (not shown in the figures).

Figure 7:
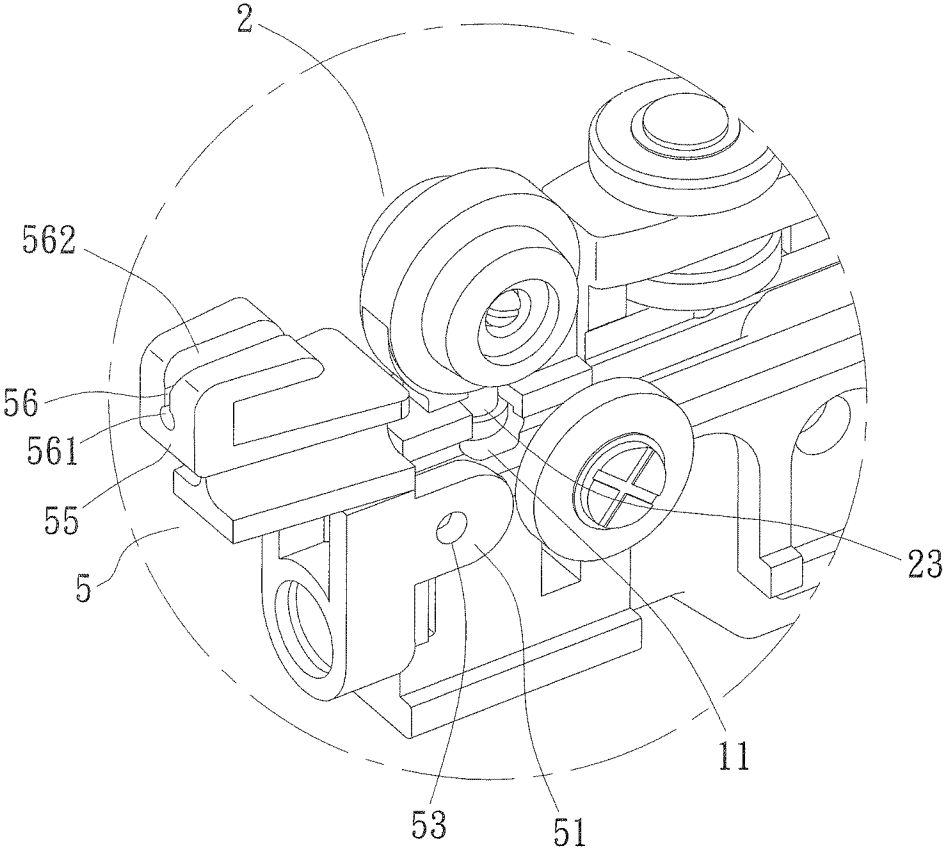
FIG. 7 is a partial enlarged view of the embodiment in FIG. 6 according to the present invention.
Figure 8:
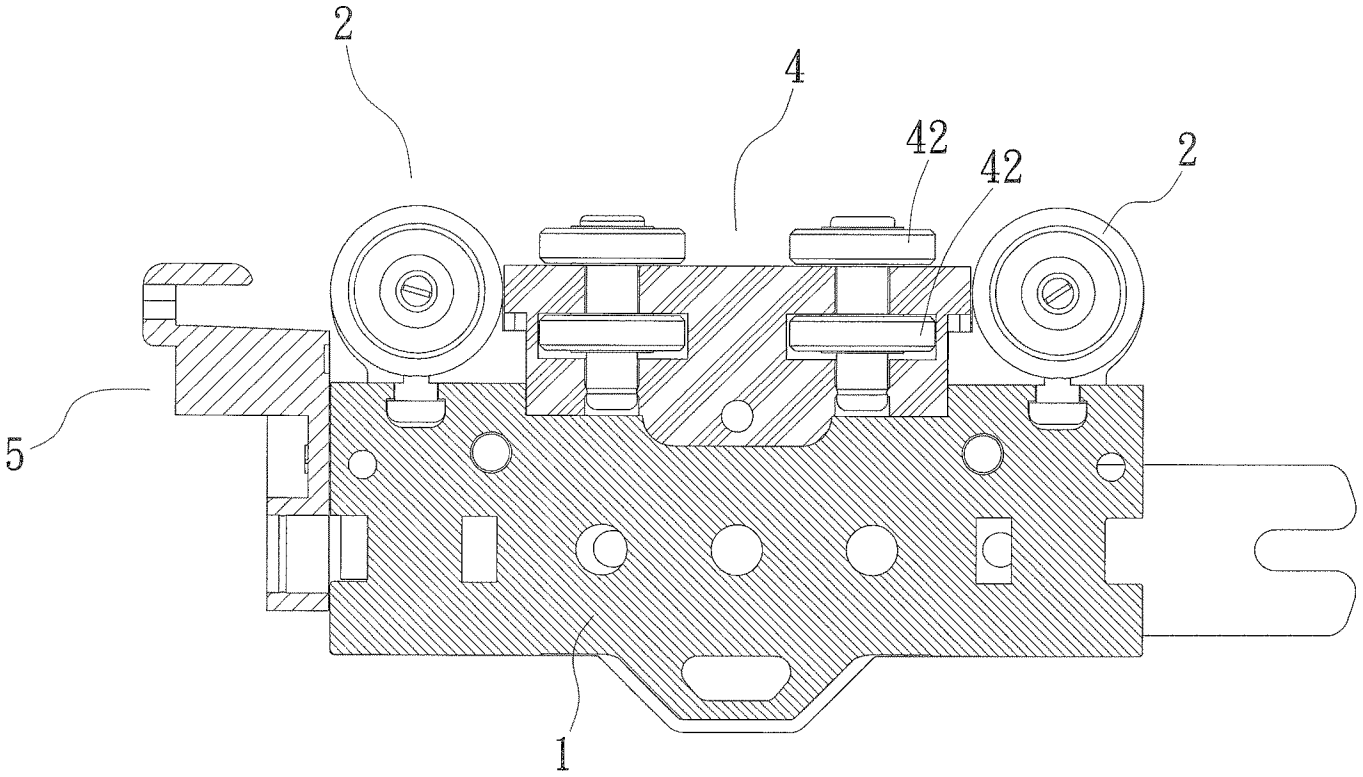
FIG. 8 is a longitudinal section of the embodiment in FIG. 6 according to the present invention.

Refer to FIG. 1 and FIG. 7, one end of the main body 1 (the right end shown in the figure) is fastened with a wire guide 5. One end of the main body 1 is set with a wire-guide assembly hole 17. One side of the wire guide 5 facing the main body 1 is disposed with two clip pieces 51 and a clip slot 52 is formed between the two clip pieces 51. Thus the wire guide 5 is clipped on one side of the main body 1. A through hole 53 is formed on each clip piece 51 and corresponding to the wire-guide assembly hole 17. A fastener 54 such as a screw is passed through the through holes 53 and the wire-guide assembly hole 17 for fastening the wire guide 5 on the main body 1. A wire holder 55 is set over the wire guide 5 and a notch 56 is disposed on top of the wire holder 55 while two side walls of the notch 56 are slopes 561 opposite to each other. A mounting hole 562 is formed on the bottom end of the notch 56.

While being assembled, the clip slot 52 formed between the two clip pieces 51 of the wire guide 5 is set on the right side of the main body 1 and the through holes 53 of the clip pieces 51 are aligned with the wire-guide assembly hole 17 of the main body 1. Then use the fastener 54 to pass through the through holes 53 and the wire-guide assembly hole 17 for connecting the wire guide 5 with the main body 1.

A concave area 18 is formed on each wall surface of the main body 1 facing the clip piece 51 of the wire guide 5. While assembling the clip pieces 51 with the main body 1, the design of the two clip pieces 51 being mounted into the concave area 18 correspondingly is used for convenient positioning of the wire guide 5 on the main body 1. Thus the wire guide 5 can be firmly fastened on the main body 1.

Figure 9:
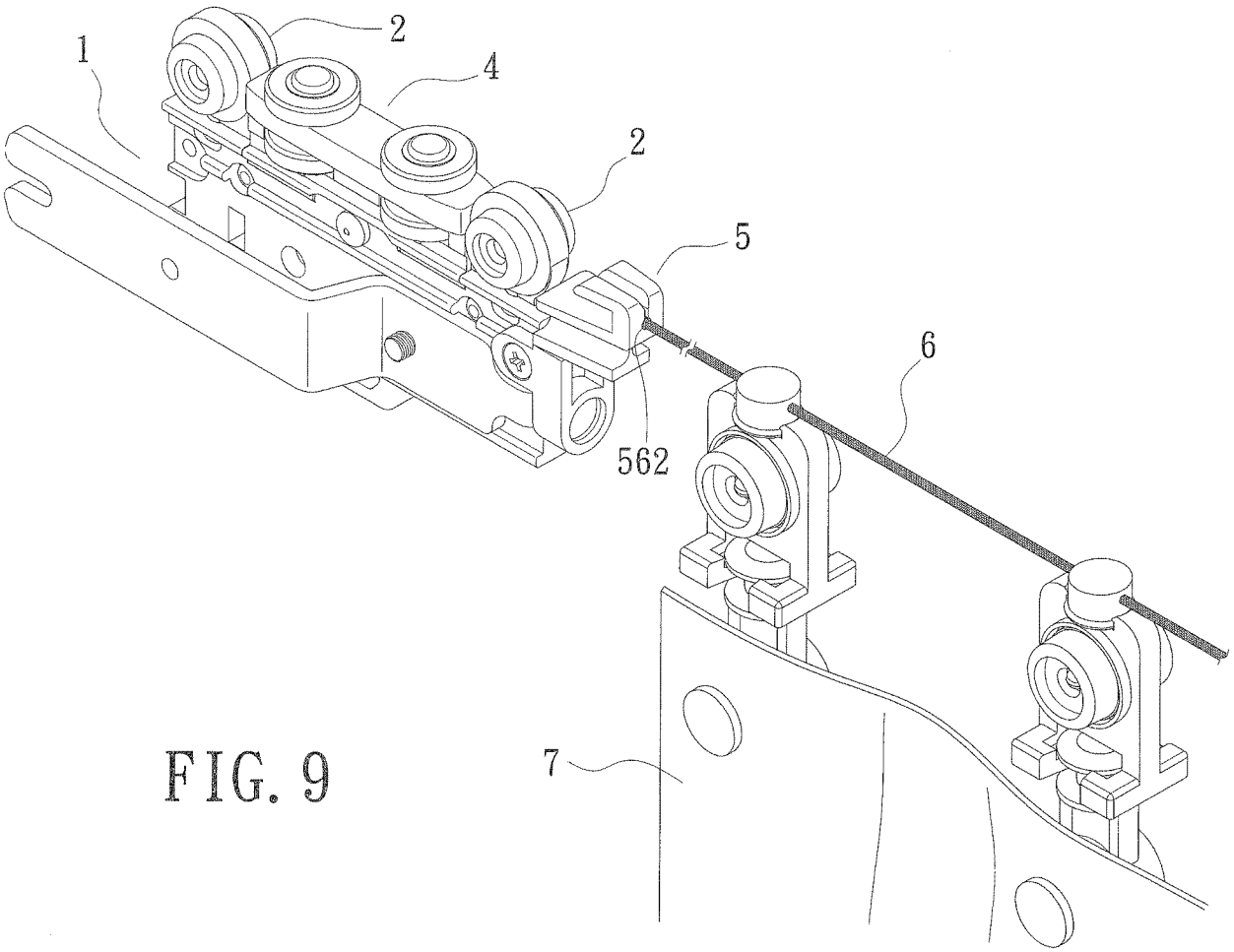
FIG. 9 is a schematic drawing showing relationship between a window curtain driving assembly, a wire and a window curtain according to the present invention.

Refer to FIG. 9, a wire 6 is slid into the mounting hole 562 on the bottom end of the notch 56 through the slopes 561 of the notch 56 on the wire holder 55 of the wire guide 5. An end part of the wire 6 is bunched into a form larger than the mounting hole 562 for fixing the wire 6 on the wire guide 5. The wire 6 is pulled by a user to drive the whole window curtain driving assembly to move when the user intends to extend or retract the curtain. A curtain 7 hooked on the window curtain driving assembly is also moved for extension or retraction.

Figure 10:
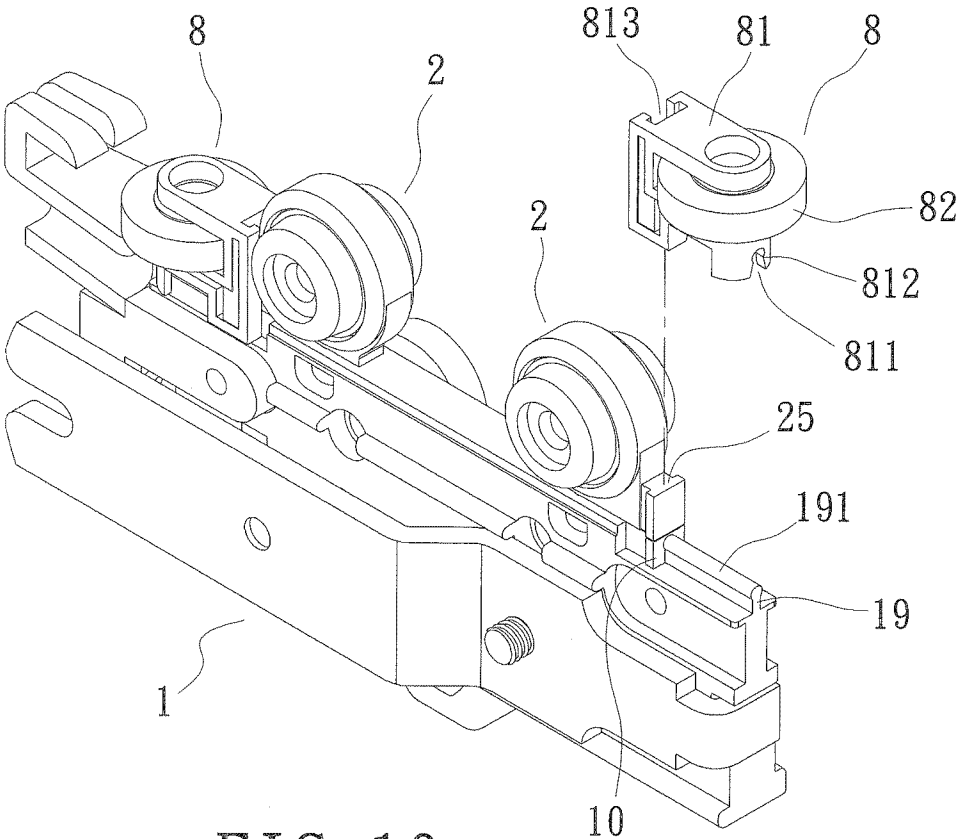
FIG. 10 is a perspective view of another embodiment according to the present invention.

Refer to FIG. 10, another embodiment of the present invention is revealed. In this embodiment, one side of each of two pulley mounts 21 away from each other is defined as an outer side. An auxiliary pulley set 8 is mounted and fixed between the outer side of the pulley mount 21 and the top of the main body 1. The auxiliary pulley set 8 is composed of an assembly base 81 and a pulley set 82 pivotally connected to the assembly base 81. The rotating shaft of the pulley set 82 is in a vertical direction while the rotating shaft of the pulley 22 is in a horizontal direction.

A mounting piece 19 is projecting from a top end of the main body 1. A locking bulge 191 is formed on a top end of the mounting piece 19. A third latch bar 25 is arranged at the outer side of the pulley mount 21 while a fourth latch bar 10 is disposed on the mounting piece 19 and aligned with the third latch bar 25. A mounting groove 811 with a downward opening is set on the assembly base 81. The mounting groove 811 having a narrow neck portion 812 is used for mounting the mounting piece 19 and the narrow neck portion 812 is locked with and positioned by the locking bulge 191. One side of the assembly base 81 corresponding to the third latch bar 25 and the fourth latch bar 10 is disposed with a mounting groove 813. The mounting groove 813 is used to hold the third latch bar 25 and the fourth latch bar 10. Thereby the auxiliary pulley set 8 is mounted and fixed between the outer side of the pulley mount 21 and the top end of the main body 1.

In this embodiment, the pulley mount 21 of the pulley driving assembly 2 is assembled with and fixed by the auxiliary pulley set 8 so that the pulley driving assembly 2 is unable to rotate on the main body 1. Thus the window curtain driving assembly of the present invention can be applied to a straight curtain track (not shown in the figure).

In order to get or enhance the color, people skilled in the art can produce colored substrates according to the method of the present invention and followed by other treatments including painting, dyeing, etc. Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A window curtain driving assembly comprising:

a main body;

at least one pulley driving assembly pivotally connected to the main body; wherein the main body is disposed with a locking part on a top thereof; the locking part includes a slot, an opening tapered inward and located at one side of the slot, and a curved hole connected to an inner end of the opening and communicating with the opening, a stopping block is arranged at and projecting from each of two sides of the slot, wherein each pulley driving assembly includes a pulley mount and two pulleys each of which is pivotally and coaxially disposed on each of two sides of the pulley mount; a locked part is integrated with a bottom of the pulley mount and locked with the locking part of the main body; the locked part having a block and a rod connected to a top end of the block; an outer diameter of the rod is smaller than an outer diameter of the block; the block is mounted into the slot correspondingly while the rod is locked and fixed in the curved hole through the opening; and an auxiliary pulley set mounted and fixed between a lateral side of the pulley mount and a top of the main body; the auxiliary pulley set includes an assembly base and at least one pulley set pivotally connected to the assembly base; the assembly base is fixed between the lateral side of the pulley mount and the top of the main body; a rotating shaft of the pulley set of the auxiliary pulley set is in a vertical direction while a rotating shaft of the pulley of the pulley driving assembly is in a horizontal direction.

2. The device as claimed in claim 1, wherein two lugs are projecting from a top of the main body and corresponding to each other; each lug is arranged with a penetrating assembly hole and a groove is formed between the two lugs; a first latch bar is disposed on a top of the main body and a second latch bar is set on one side of the pulley mount close to the auxiliary pulley set; the first latch bar is aligned with the second latch bar; an insertion piece corresponding to the groove and having an insertion hole is arranged at the assembly base; the insertion piece is mounted into the groove and a positioning part is passed through the insertion hole and the assembly holes so as to dispose the auxiliary pulley set over the main body.

3. The device as claimed in claim 2, wherein a mounting groove having a side opening and corresponding to the second latch bar is disposed on the auxiliary pulley set; the mounting groove is used for mounting the second latch bar and the first latch bar.

4. The device as claimed in claim 3, wherein a wire guide is fastened on one end of the main body; the wire guide is connected to a wire; the main body is driven to move by the wire through the wire guide.

5. The device as claimed in claim 4, wherein one end of the main body is set with a wire-guide assembly hole; one side of the wire guide facing the main body is disposed with two clip pieces and a clip slot is formed between the two clip pieces; a through hole is formed on each clip piece and corresponding to the wire-guide assembly hole; a fastener is passed through the through holes and the wire-guide assembly hole to fasten the wire guide on the main body; a wire holder is set over the wire guide and a notch is formed on top of the wire holder while two side walls of the notch are slopes opposite to each other; a mounting hole is formed on a bottom of the notch; the wire is slid into the mounting hole on the bottom of the notch through the slopes and an end part of the wire is bunched into a form larger than the mounting hole for fixing the wire on the wire guide.

6. The device as claimed in claim 2, wherein one side of the pulley mount away from the other pulley mount is defined as an outer side when the window curtain driving assembly includes two pulley driving assemblies; an auxiliary pulley set is mounted and fixed between the outer side of the pulley mount and a top of the main body; the auxiliary pulley set includes an assembly base and a pulley set pivotally connected to the assembly base; a rotating shaft of the pulley set is in a vertical direction while a rotating shaft of the pulley is in a horizontal direction.

7. The device as claimed in claim 6, wherein a mounting piece is projecting from a top of the main body and a locking bulge is formed on a top of the mounting piece; a third latch bar is arranged at the outer side of the pulley mount while a fourth latch bar is disposed on the mounting piece and aligned with the third latch bar; a mounting groove having a downward opening and a narrow neck portion is set on the assembly base and used for mounting the mounting piece; the narrow neck portion is locked with and positioned by the locking bulge; one side of the assembly base corresponding to the third latch bar and the fourth latch bar is disposed with a mounting groove; the mounting groove is used to mount the third latch bar and the fourth latch bar.

8. The device as claimed in claim 1, wherein a wire guide is fastened on one end of the main body; the wire guide is connected to a wire; the main body is driven to move by the wire through the wire guide.

9. The device as claimed in claim 8, wherein one end of the main body is set with a wire-guide assembly hole; one side of the wire guide facing the main body is disposed with two clip pieces and a clip slot is formed between the two clip pieces; a through hole is formed on each clip piece and corresponding to the wire-guide assembly hole; a fastener is passed through the through holes and the wire-guide assembly hole to fasten the wire guide on the main body; a wire holder is set over the wire guide and a notch is formed on top of the wire holder while two side walls of the notch are slopes opposite to each other; a mounting hole is formed on a bottom of the notch; the wire is slid into the mounting hole on the bottom of the notch through the slopes and an end part of the wire is bunched into a form larger than the mounting hole for fixing the wire on the wire guide.

10. A window curtain driving assembly comprising:

a main body;

at least one pulley driving assembly pivotally connected to the main body; wherein the main body is disposed with a locking part on a top thereof; the locking part includes a slot, an opening tapered inward and located at one side of the slot, and a curved hole connected to an inner end of the opening and communicating with the opening, wherein each pulley driving assembly includes a pulley mount and two pulleys each of which is pivotally and coaxially disposed on each of two sides of the pulley mount; a locked part is integrated with a bottom of the pulley mount and locked with the locking part of the main body; the locked part having a block and a rod connected to a top end of the block; an outer diameter of the rod is smaller than an outer diameter of the block; the block is mounted into the slot correspondingly while the rod is locked and fixed in the curved hole through the opening; and an auxiliary pulley set mounted and fixed between a lateral side of the pulley mount and a top of the main body; the auxiliary pulley set includes an assembly base and at least one pulley set pivotally connected to the assembly base; the assembly base being fixed between the lateral side of the pulley mount and the top of the main body; a rotating shaft of the pulley set of the auxiliary pulley set being in a vertical direction while a rotating shaft of the pulley of the pulley driving assembly is in a horizontal direction.

11. The device as claimed in claim 10, wherein two lugs are projecting from a top of the main body and corresponding to each other; each lug is arranged with a penetrating assembly hole and a groove is formed between the two lugs; a second latch bar is set on one side of the pulley mount close to the auxiliary pulley set while a first latch bar is disposed on a top of the main body; the first latch bar is aligned with the second latch bar; an insertion piece corresponding to the groove and having an insertion hole is arranged at the assembly base; the insertion piece is mounted into the groove and a positioning part is passed through the insertion hole and the assembly holes so as to dispose the auxiliary pulley set over the main body.

12. The device as claimed in claim 11, wherein a mounting groove having a side opening and corresponding to the second latch bar is disposed on the auxiliary pulley set; the mounting groove is used for mounting the second latch bar and the first latch bar.

13. The device as claimed in claim 12, wherein a wire guide is fastened on one end of the main body; the wire guide is connected to a wire; the main body is driven to move by the wire through the wire guide.

14. The device as claimed in claim 13, wherein one end of the main body is set with a wire-guide assembly hole; one side of the wire guide facing the main body is disposed with two clip pieces and a clip slot is formed between the two clip pieces; a through hole is formed on each clip piece and corresponding to the wire-guide assembly hole; a fastener is passed through the through holes and the wire-guide assembly hole to fasten the wire guide on the main body; a wire holder is set over the wire guide and a notch is formed on top of the wire holder while two side walls of the notch are slopes opposite to each other; a mounting hole is formed on a bottom of the notch; the wire is slid into the mounting hole on the bottom of the notch through the slopes and an end part of the wire is bunched into a form larger than the mounting hole for fixing the wire on the wire guide.

15. A window curtain driving assembly comprising:

a main body;

at least one pulley driving assembly pivotally connected to the main body; wherein the main body is disposed with a locking part on a top thereof; the locking part includes a slot, an opening tapered inward and located at one side of the slot, and a curved hole connected to an inner end of the opening and communicating with the opening, wherein each pulley driving assembly includes a pulley mount and two pulleys each of which is pivotally and coaxially disposed on each of two sides of the pulley mount; a locked part is integrated with a bottom of the pulley mount and locked with the locking part of the main body; the locked part having a block and a rod connected to a top end of the block; an outer diameter of the rod is smaller than an outer diameter of the block; the block is mounted into the slot correspondingly while the rod is locked and fixed in the curved hole through the opening; and a wire guide fastened on one end of the main body; the wire guide being connected to a wire; the main body being driven to move by the wire through the wire guide.

16. The device as claimed in claim 15, wherein one end of the main body is set with a wire-guide assembly hole; one side of the wire guide facing the main body is disposed with two clip pieces and a clip slot is formed between the two clip pieces; a through hole is formed on each clip piece and corresponding to the wire-guide assembly hole; a fastener is passed through the through holes and the wire-guide assembly hole to fasten the wire guide on the main body; a wire holder is set over the wire guide and a notch is formed on top of the wire holder while two side walls of the notch are slopes opposite to each other; a mounting hole is formed on a bottom of the notch; the wire is slid into the mounting hole on the bottom of the notch through the slopes and an end part of the wire is bunched into a form larger than the mounting hole for fixing the wire on the wire guide.

17. A window curtain driving assembly comprising:

a main body;

at least one pulley driving assembly pivotally connected to the main body; wherein the main body is disposed with a locking part on a top thereof; the locking part includes a slot, an opening tapered inward and located at one side of the slot, and a curved hole connected to an inner end of the opening and communicating with the opening, wherein each pulley driving assembly includes a pulley mount and two pulleys each of which is pivotally and coaxially disposed on each of two sides of the pulley mount; a locked part is integrated with a bottom of the pulley mount and locked with the locking part of the main body; the locked part having a block and a rod connected to a top end of the block; an outer diameter of the rod is smaller than an outer diameter of the block; the block is mounted into the slot correspondingly while the rod is locked and fixed in the curved hole through the opening; and one side of the pulley mount away from the other pulley mount being defined as an outer side when the window curtain driving assembly includes two pulley driving assemblies; an auxiliary pulley set being mounted and fixed between the outer side of the pulley mount and a top of the main body; the auxiliary pulley set includes an assembly base and a pulley set pivotally connected to the assembly base; a rotating shaft of the pulley set being in a vertical direction while a rotating shaft of the pulley is in a horizontal direction.

18. The device as claimed in claim 17, wherein a mounting piece is projecting from a top of the main body and a locking bulge is formed on a top of the mounting piece; an outer latch bar is arranged at the outer side of the pulley mount while an other latch bar is disposed on the mounting piece and aligned with the outer latch bar; a mounting groove having a downward opening and a narrow neck portion is set on the assembly base and used for mounting the mounting piece; the narrow neck portion is locked with and positioned by the locking bulge; one side of the assembly base corresponding to the outer latch bar and the other latch bar is disposed with a mounting groove; the mounting groove is used to mount the outer latch bar and the other latch bar.

* * * * *